US010052788B2

(12) United States Patent
Windrim et al.

(10) Patent No.: US 10,052,788 B2
(45) Date of Patent: Aug. 21, 2018

(54) ADJUSTABLE FLAIL ASSEMBLY FOR DEBARKING MACHINE

(71) Applicant: Astec Industries, Inc., Chattanooga, TN (US)

(72) Inventors: Malcolm Angus Windrim, Lavington (AU); Nathan Anderson, Eugene, OR (US)

(73) Assignee: Astec Industries, Inc., Chattanooga, TN (US)

( * ) Notice: Subject to any disclaimer, the term of this patent is extended or adjusted under 35 U.S.C. 154(b) by 169 days.

(21) Appl. No.: 15/142,632

(22) Filed: Apr. 29, 2016

(65) Prior Publication Data

US 2016/0325461 A1 Nov. 10, 2016

Related U.S. Application Data

(60) Provisional application No. 62/156,399, filed on May 4, 2015.

(51) Int. Cl.
*B27L 1/12* (2006.01)

(52) U.S. Cl.
CPC ..... *B27L 1/122* (2013.01)

(58) Field of Classification Search
CPC ..... B27L 1/00; B27L 1/08; B27L 1/10; B27L 1/12; B27L 1/122; B27L 1/125; B27L 1/127
See application file for complete search history.

(56) References Cited

U.S. PATENT DOCUMENTS 5,322,104 A * 6/1994 Morey ..... B27L 1/122 144/208.7
5,349,999 A * 9/1994 Peterson ..... A01G 23/097 144/208.7
2015/0076265 A1* 3/2015 Peterson ..... B27L 1/122 241/101.4

* cited by examiner

*Primary Examiner* — Matthew G Katcoff
(74) *Attorney, Agent, or Firm* — Chambliss, Bahner & Stophel, P.C.

(57) ABSTRACT

A debarking machine for removing the bark from a log includes a flail assembly having a flail shaft that is mounted for rotation about a flail shaft axis. A plurality of flail chains are provided, each of which has a fixed end that is attached to the flail shaft and a free end. The debarking machine is adapted to move a log to be debarked in a processing direction that is generally perpendicular to the flail shaft axis. A flail housing encloses a portion of the flail assembly and is configured and arranged to locate the flail shaft at any of a plurality of alternative vertical positions with respect to the log being moved in the processing direction.

3 Claims, 5 Drawing Sheets

ADJUSTABLE FLAIL ASSEMBLY FOR DEBARKING MACHINE

CROSS-REFERENCE TO RELATED APPLICATION

This application claims the benefit of U.S. Provisional Patent Application No. 62/156,399, which was filed on May 4, 2015.

FIELD OF THE INVENTION

The present invention relates generally to devices for removing the bark and small limbs from logs, and more particularly, to a flail assembly that can be adjustably located and configured within the flail housing of a debarking machine and/or with respect to the frame of the debarking machine.

BACKGROUND OF THE INVENTION

In processing logs for various purposes, it is usually necessary to first remove the bark and limbs from the logs. Debarking machines are known for this purpose, and frequently include flail assemblies comprising two or more rotating shafts to which are attached multiple flail chains. If the logs are intended to be processed into chips, it is common for a debarking machine to be located adjacent to, attached to or combined with a log chipping machine. Furthermore, it is desirable to completely remove all bark prior to the chipping process, because bark is considered to be a contaminant in the chips.

In the debarking machine, logs are introduced into the space between the flail assemblies in a direction normal to the axes of rotation of the flail shafts. Typically, the shafts are arranged so that at least one is an upper shaft and another is a lower shaft, although they may be laterally offset from each other. In such a device, the feed line along which the logs are passed through the machine is located between an upper shaft and a lower shaft. In order to remove the bark and limbs from the log, at least some of the flail chains on the upper shaft must reach down along the sides of the log to at least the mid-point. Similarly, at least some of the flail chains on the lower shaft must reach upwardly along the sides of the log to the mid-point. The length of the flail chains on each shaft is dictated by the size of the largest log that is intended to be debarked and the size and positioning of the flail shafts in the debarking machine.

Flail chains may be thirty-six inches long or longer, and are mounted close together. During the debarking operation, the flail chains are subjected to significant stress. As a result, the chain links at the free ends of the flail chains will often break, typically requiring replacement of the flail chains in order to maintain the proper chain length. When the chain links at the free ends of the flail chains break, the other chain links in the flail chain are typically undamaged. Nevertheless, conventional practice requires discarding a flail chain when only one or a few links are damaged. Furthermore, it is a labor-intensive and time-consuming project to change all of the flail chains in a flail assembly.

The upper flail assembly may be mounted on the free end of a pivotable arm structure. In such circumstances, and depending on the relative location of any lower flail assemblies, the action of the flail against the surface of a log may create a reaction force that causes the flail assembly to "float" above the log. An example of such a flail assembly is shown in U.S. Pat. No. 4,719,950 ("the '950 patent"). As described therein, one end of a linear actuator is mounted to the machine frame and the other end is mounted to the pivotable arm structure at an intermediate position between the flail shaft and the pivot mount for the arm structure. This linear actuator is adapted to generate an upwardly directed force against the pivotable arm structure in order to offset only a part of the weight of the flail assembly, so that an additional force is required to raise the flail assembly. This additional force is provided by a gate that is mounted to the pivotable arm structure between the linear actuator and the pivot mount for the arm structure. However, the gate is mounted to extend downwardly at a fixed angle, so that the log being processed, regardless of its diameter, will push against the gate as the log is carried between the upper flail assembly and a fixed lower flail assembly. This gate insures that the shaft of the flail assembly is always a distance above the top of the log being processed that is determined by the configuration of the pivotable arm structure, the location of the linear actuator and the relative angle of the gate. The pivotable arm structure of the '950 patent cannot change the vertical location of the flail assembly shaft independently of the movement generated by the log being processed pushing against the gate. Furthermore, no mechanism is provided in the debarking machine disclosed in the '950 patent to allow for the use of flail chains that are shorter or longer than those shown. Therefore, if flail chains in the flail assembly of the '950 patent become damaged, they will all have to be replaced in order to maintain an efficient debarking operation. Furthermore, if it were deemed desirable to use shorter flail chains in the upper flail assembly of the debarking device of the '950 patent, the flail chains would not reach down far enough to provide for complete bark removal in the logs being processed. If it were deemed desirable to use longer flail chains, the flail chains of the upper flail assembly could damage the adjacent lower flail assembly or other components of the debarking device.

Consequently, it would be desirable if a flail assembly could be provided that would not require replacement of all of the flail chains when the free ends or one or more are damaged. It would be desirable if a flail assembly for a debarking machine could be provided that is adjustable in a vertical direction independently of the diameter of the log being processed. It would also be desirable if a flail assembly for a debarking machine could be provided that can use flail chains of differing lengths, depending on the desired operating conditions, which flail assembly is vertically adjustable without requiring contact between any support structure for the flail assembly and the log being processed.

Advantages of the Invention

Among the advantages of the invention is that it provides a flail assembly that may be adjustably mounted so as to permit the continued use of flail chains after the chain links on their free ends have been damaged or broken. It also provides a flail assembly that can use flail chains of various lengths. The invention also provides a flail assembly for a debarking machine that is adjustable in a vertical direction independently of the diameter of the log being processed. It also provides a flail assembly for a debarking machine that can use flail chains of differing lengths, depending on the desired operating conditions, which flail assembly is vertically adjustable without requiring contact between any support structure for the flail assembly and the log being processed. Other advantages and features of this invention will become apparent from an examination of the drawings and the ensuing description.

Notes on Construction

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic.

The use of any and all examples or exemplary language (e.g., "such as" and "preferably") herein is intended merely to better illuminate the invention and the preferred embodiment thereof, and not to place a limitation on the scope of the invention. Nothing in the specification should be construed as indicating any element as essential to the practice of the invention unless so stated with specificity.

Various terms are specifically defined herein. These terms are to be given their broadest possible construction consistent with such definitions, as follows:

The term "debarking machine" refers to a machine for removing bark and small limbs from a log or to a machine having a debarking component and a log chipping component.

The term "shaft", when used in reference to a flail assembly, comprises a shaft, disc or drum that is rotatable about an axis of rotation and to which one or more flail chains (as hereinafter defined) are attached.

The term "flail chain" refers to a chain or other elongate flexible device comprised of a plurality of interconnected components, one end of which is attached to a shaft that is rotated so that the free end, or a portion thereof, can come into contact with a log in a debarking machine or a debarking component of a combination debarking and chipping machine.

The term "chain link" refers to the links or other individual components that are interconnected to form a flail chain.

The term "flail assembly" refers to the shaft and bearings associated therewith, with flail chains attached.

The term "flail housing" refers to a housing that partially surrounds the flail assembly and may be pivotally attached to the frame of the debarking machine.

The term "processing direction" refers to the direction of travel of a log for processing through a flail assembly.

The term "vertical" and similar terms, when used to refer to a position or distance to, from or with respect to a shaft of a flail assembly, refers to a position or distance along a line that is generally perpendicular to the axis of rotation of the shaft and to the processing direction.

The terms "above", "upwardly" and similar terms, when used in reference to a relative direction on or with respect to a flail assembly, or a debarking machine, or a component or portion of such an assembly or machine, refer to a relative direction that is farther away from the surface on which the assembly or machine is placed in order to process logs.

The terms "below", "downwardly" and similar terms, when used in reference to a relative direction on or with respect to a flail assembly, or a debarking machine, or a component or portion of such an assembly or machine, refer to a relative direction that is closer to the surface on which the assembly or machine is placed in order to process logs.

The term "front end" and similar terms refer to the end of a debarking machine or a component or portion of such a machine, which is nearest the point at which a log to be processed is introduced into the machine.

The terms "forward", "in front of", and similar terms, as used herein to describe a relative position or direction on or in connection with a debarking machine, or a component of such a machine, refer to a relative position or direction towards the front end of the machine.

The terms "back end", "rear end" and similar terms refer to the end of a debarking machine or a component or portion of such a machine, which is farther from the front end of the machine.

The terms "rearward", "behind", and similar terms, as used herein to describe a relative position or direction on or in connection with a debarking machine or a component of such a machine, refer to a relative position or direction towards the rear end of the machine.

The term "actuator" refers to an electric, hydraulic, pneumatic, electro-hydraulic or mechanical device that is adapted to apply a force to a component of a debarking machine with respect to the flail housing, frame or another component of the machine.

The term "linear actuator" refers to an actuator that generates force which is directed in a straight line. Common examples of "linear actuators" include double-acting hydraulic or pneumatic actuators which include a cylinder, a piston within the cylinder, and a rod attached to the piston. By increasing the pressure within the cylinder on one side of the piston (over that on the opposite side of the piston), the rod will extend from the cylinder or retract into the cylinder.

SUMMARY OF THE INVENTION

The invention comprises a flail assembly for a debarking machine. The flail assembly includes a shaft that is mounted for rotation about an axis that is generally perpendicular to the processing direction in which logs are moved for debarking and generally parallel to the plane of the surface on which the machine is placed. Attached to this shaft are a plurality of flail chains, each of which has a fixed end that is attached to the shaft, and a free end. The length of each flail chain defines an arc of rotation of the free end of the flail chain as the shaft is rotated. The invention comprises a flail assembly having a flail shaft that is adapted to be mounted in a plurality of alternative vertical positions with respect to a log being moved in the processing direction, wherein said positions are independent of the size or position of the log being processed, because the invention does not require that any part of the flail housing associated with the flail assembly contact the log being processed as it is moved in the processing direction. The invention may be employed to place the flail assembly at an optimum flailing position, regardless of the length of the flail chains on the flail assembly. The invention contemplates that as the flail chains wear and are broken, the worn or broken chain links may be removed and the vertical location of the shaft of the flail assembly adjusted to compensate for the reduction in length of the flail chains. In other circumstances, it may be desirable to vertically locate the shaft in alternative positions to provide for flail assemblies that can employ flail chains of different lengths.

In a preferred embodiment of the invention, the flail assembly is mounted within a flail housing that is itself pivotally attached to the machine frame. A linear actuator is mounted between the flail housing and the frame of the machine to generate a linearly directed force that counterbalances at least a part of the weight of the flail housing. A support stop is also mounted to the frame of the machine near the free end of the flail housing to prevent the free end of the flail assembly from falling below a predetermined vertical position (which is adjustable), in order to prevent the flail chains from "floating" to a position that is likely to cause damage to other components of the debarking machine.

When one or more chain links on the free end of one or more flail chains are damaged, broken or lost in operation of the flail assembly, or if for one reason or another, it is deemed desirable to change the length of the flail chains of a flail assembly, the vertical position of the shaft of the flail assembly may be changed and/or the combination of the vertical position of the shaft and the length of the flail chains may be changed, so that when the damaged chain links on the flail chains are removed or shorter flail chains are substituted, the shortened free ends of the flail chains will extend as far or nearly as far as the free ends of the original (or undamaged) flail chains, or otherwise as far as is desired.

In order to facilitate an understanding of the invention, the preferred embodiments of the invention and the best mode known by the inventors for carrying out the invention are illustrated in the drawings, and a detailed description thereof follows. It is not intended, however, that the invention be limited to the particular embodiments described or to use in connection with the apparatus illustrated herein. Therefore, the scope of the invention contemplated by the inventors includes all equivalents of the subject matter described herein, as well as various modifications and alternative embodiments such as would ordinarily occur to one skilled in the art to which the invention relates. The inventors expect skilled artisans to employ such variations as seem to them appropriate, including the practice of the invention otherwise than as specifically described herein. In addition, any combination of the elements and components of the invention described herein in any possible variation is intended to be encompassed by the claims, unless otherwise indicated herein or clearly excluded by context.

DESCRIPTION OF THE PREFERRED EMBODIMENTS OF THE INVENTION

Figure 1:
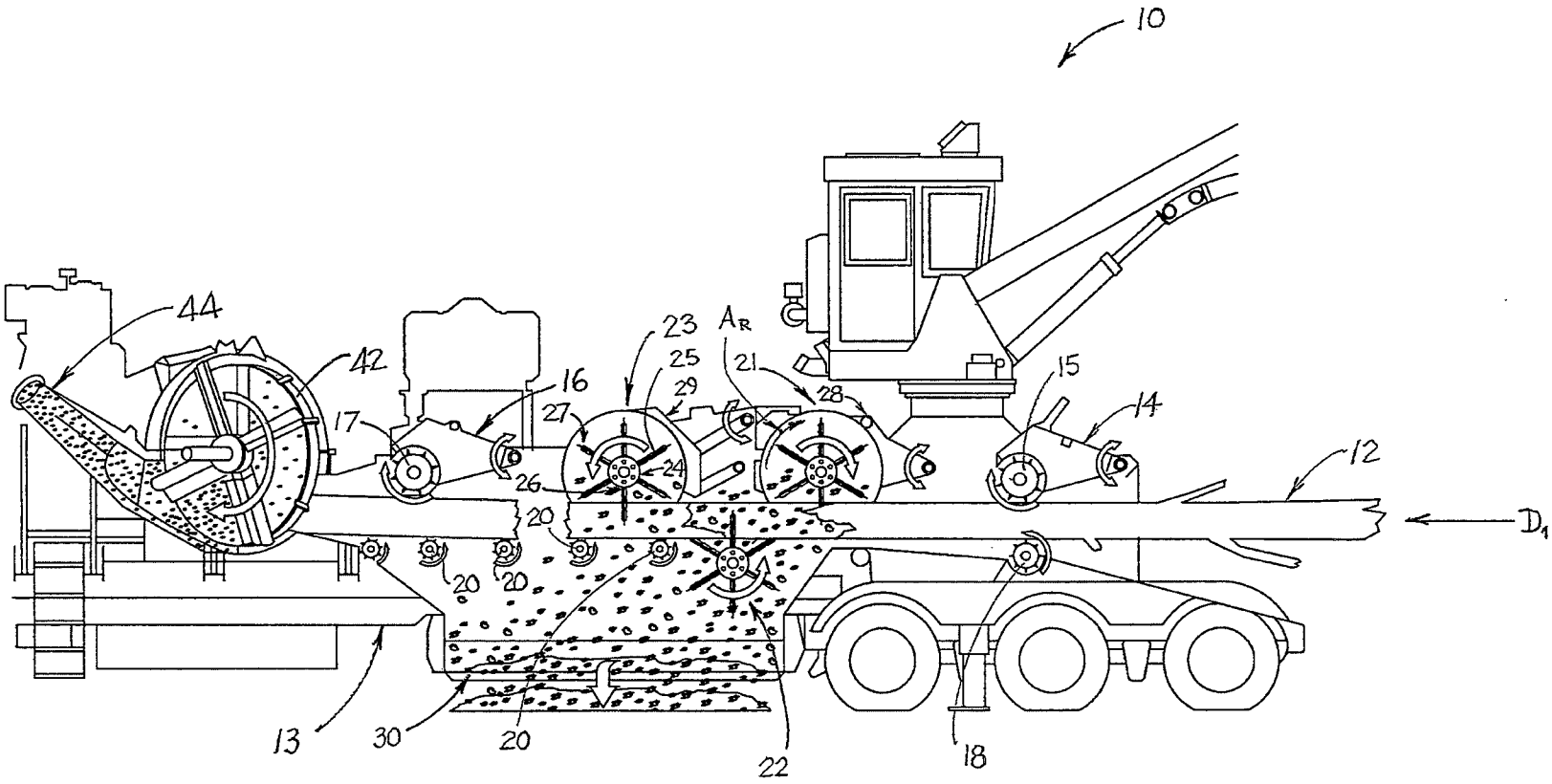
FIG. 1 is a side view, partially in section, of a combination debarking and log chipping machine that may be equipped with the flail assembly and support structure of the invention.

As shown in FIG. 1, machine 10 is a combination debarking machine and log chipping machine that is adapted to process a log such as log 12. The log is carried through the machine in processing direction $D_1$ by contact with a plurality of rotating feed rolls. Upper feed roll assemblies 14 and 16 are pivotally mounted on the frame 13 of the machine above the log and are adapted to rotate feed rolls 15 and 17 respectively in a clockwise direction (as shown in FIG. 1). Lower feed rolls 18 and 20 are mounted below the log and are adapted to rotate in a counterclockwise direction (as shown in FIG. 1). Upper feed roll 15 and lower feed roll 18 cooperate to move log 12 into contact with flail assemblies 21, 22 and 23. Each of the flail assemblies includes a shaft 24 to which are attached a plurality of flail chains 25. Each shaft 24 is driven by a motor or other known means so as to rotate about an axis of rotation that is perpendicular to the plane of the page of FIG. 1. Such axis of rotation is generally perpendicular to the processing direction and generally parallel to the surface on which machine 10 is placed for operation. Each flail chain has a fixed end 26 that is attached to a shaft and a free end 27. Each flail chain is of a length that defines an arc of rotation $A_R$ of the free end 27 of the flail chain 25. Rotation of the flail shafts causes the flail chains to flail the bark from the log. In the illustrated embodiment of the invention, the shaft of first upper flail assembly 21 rotates in a clockwise direction, while the shafts of lower flail assembly 22 and second upper flail assembly 23 rotate in a counterclockwise direction, when viewed from the perspective of FIG. 1. Upper flail assemblies 21 and 23 are rotatably mounted in flail housings 28 and 29 respectively, and the flail housings 28 and 29 are pivotally mounted to the frame of machine 10.

Much of the bark that is removed by the flail assemblies falls into bark removal conveyor 30 for removal from the machine. Upper feed roll 17 helps to advance the flailed log into chipper disk 42, which rotates in a clockwise direction (as shown in FIG. 1) to reduce the log to chips that pass out of the machine through chute 44.

Figure 2:
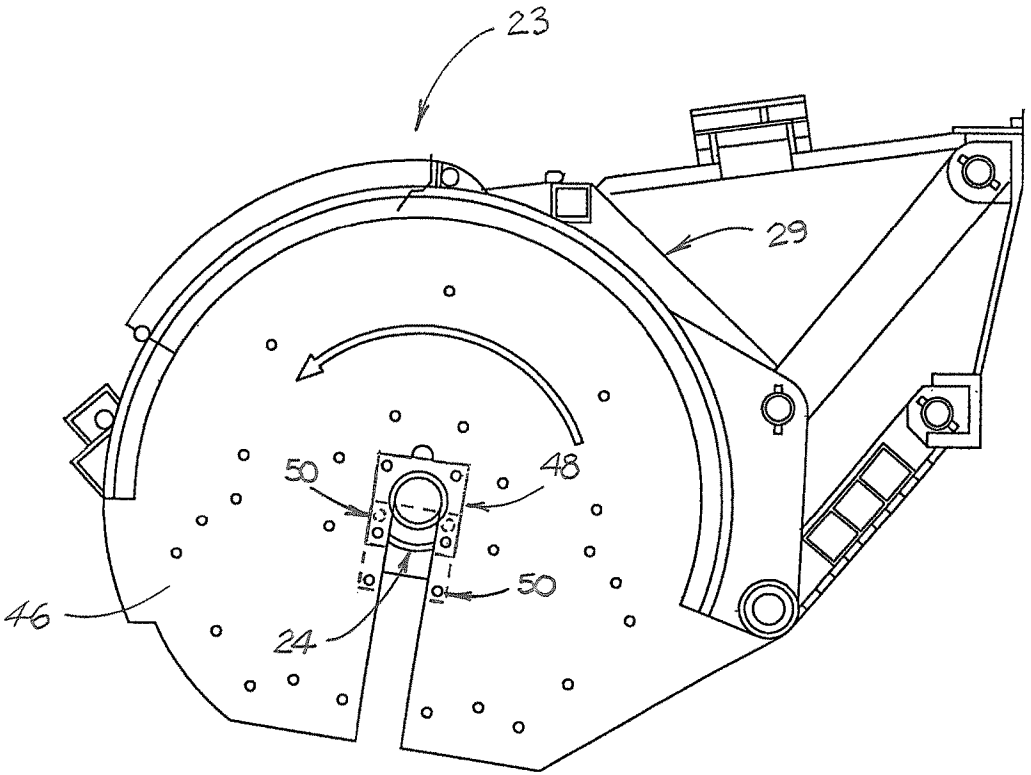
FIG. 2 is a side view of the flail housing for one of the flail assemblies of the combination debarking and log chipping machine shown in FIG. 1, which illustrates two alternative vertical positions for the shaft of the flail assembly according to the invention.

FIG. 2 is a detailed view of upper flail assembly 23 showing sidewall 46 (which is not shown in FIG. 1) of flail housing 29. In this embodiment of the invention, shaft 24 of flail assembly 23 is mounted to the flail housing by a pair of mounting brackets, including mounting bracket 48 that is attached to sidewall 46 and an identical bracket (not shown) that is attached to a sidewall (also not shown, but a mirror image of sidewall 46) on the other side of flail housing 29 (from the perspective of FIG. 2). A plurality of fastener holes 50 are provided through sidewall 46 and adapted to be aligned with similarly spaced holes in mounting bracket 48 for placement of cooperating fasteners to locate mounting bracket 48 in an upper position (indicated by solid lines in FIG. 2, which corresponds to position $S_1$ shown in FIGS. 3-6) or a lower position (indicated by dashed lines, which corresponds to position $S_2$ shown in FIGS. 7 and 8) with respect to the sidewall of the flail housing. Similarly spaced holes are provided in the sidewall on the other side of flail housing 29 (from the perspective of FIG. 2) for similar placement of a mounting bracket for the opposite end of shaft 24 in an upper position corresponding to $S_1$ or a lower position corresponding to $S_2$. It is contemplated within the scope of the invention that suitable holes or other means may be provided to locate the mounting brackets (and thus, shaft 24) in more than two alternative vertical positions with respect to the log being moved in the processing direction through machine 10. In this embodiment of the invention, flail assembly 23 is adjustably mounted within flail housing 29 in such a manner that the vertical distance between shaft 24 of the flail assembly and the log being moved in the processing direction can be changed by moving the mounting brackets, including mounting bracket 48, between their alternative fixation positions. This embodiment of the invention thus contemplates providing for the shaft of a flail assembly to be located in a plurality of alternative vertical positions with respect to the sidewalls of the flail housing.

The shaft for either an upper or a lower flail assembly may be adjustably mounted in a flail housing or a mounting assembly for a flail assembly that permits vertical positioning of the shaft at a plurality of alternative vertical positions, so that flail chains that are damaged or otherwise shortened may continue to be used, or if for other reasons it is desirable to adjust the vertical location of the shaft of the flail assembly. This allows the operator of a debarking machine to position the shaft of the flail assembly in a suitable position that will allow for efficient debarking operation of logs of any suitable size, using flail chains of any suitable length, without running the risk that the flail chains will damage other components of the debarking machine. Furthermore, the invention provides a flail housing which comprises a support structure for the flail assembly and is adapted to locate the flail assembly in alternative vertical positions without requiring contact between any portion of the support structure for the flail assembly and the log being processed.

In a preferred embodiment of the invention, the flail housing has a pivot end which is pivotally mounted to the frame of the debarking machine and a free end. In this embodiment of the invention, a support stop that is attached to the frame of the debarking machine is provided to prevent the free end of the flail housing from falling or drifting below a predetermined vertical position as the flail assembly "floats" with respect to the log being processed, which position may be vertically adjusted depending on operating conditions. Thus, each of FIGS. 3-8 illustrates a portion of a flail assembly and flail housing for a debarking machine or a combination debarking and chipping machine that may be similar to machine 10, except that processing direction $D_2$ shown in FIGS. 3-8 is oriented 180° from that of processing direction $D_1$ of machine 10 shown in FIG. 1, and the flail housing is pivotally mounted so as to pivot about pivot axis P with respect to the frame of the machine.

Figure 5:
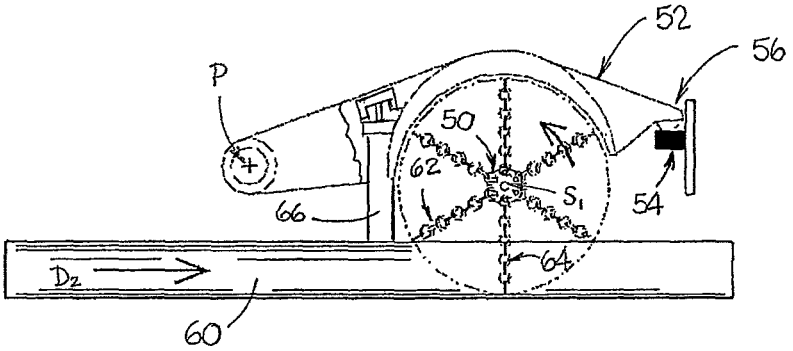
FIG. 5 is a side view of a portion of a flail housing and a flail assembly of a preferred embodiment of the invention, showing the operation of a flail assembly having chains of the first length that is mounted in the upper position in the flail housing in connection with the debarking of a log of a second size that has a smaller diameter than that shown in FIGS. 3 and 4.
Figure 6:
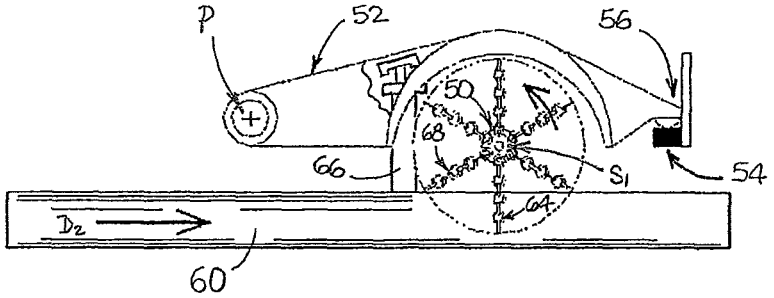
FIG. 6 is a side view of a portion of a flail housing and a flail assembly of a preferred embodiment of the invention, showing the operation of a flail assembly having chains of the second length that is mounted in the upper position in the flail housing in connection with the debarking of a log of the second size.
Figure 7:
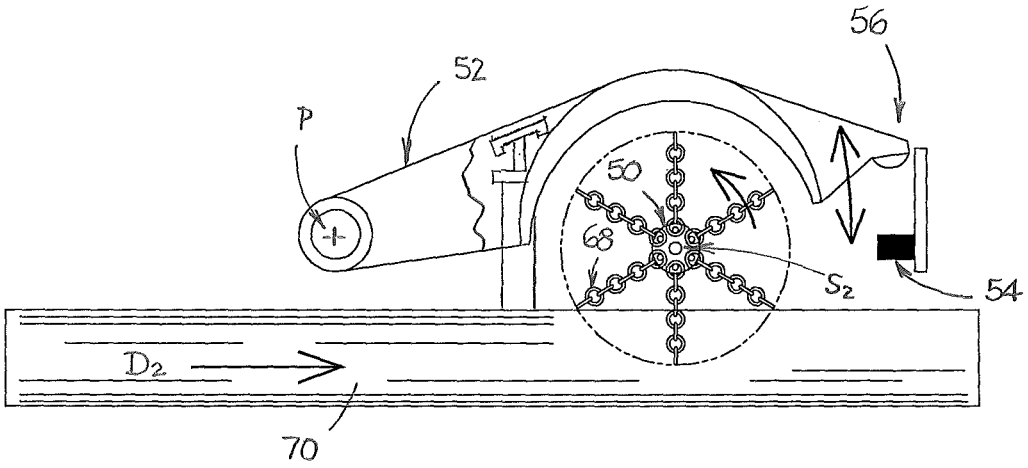
FIG. 7 is a side view of a portion of a flail housing and a flail assembly of a preferred embodiment of the invention, showing the operation of a flail assembly having chains of the second length that is mounted in a lower position in the flail housing in connection with the debarking of a log of the first size.
Figure 8:
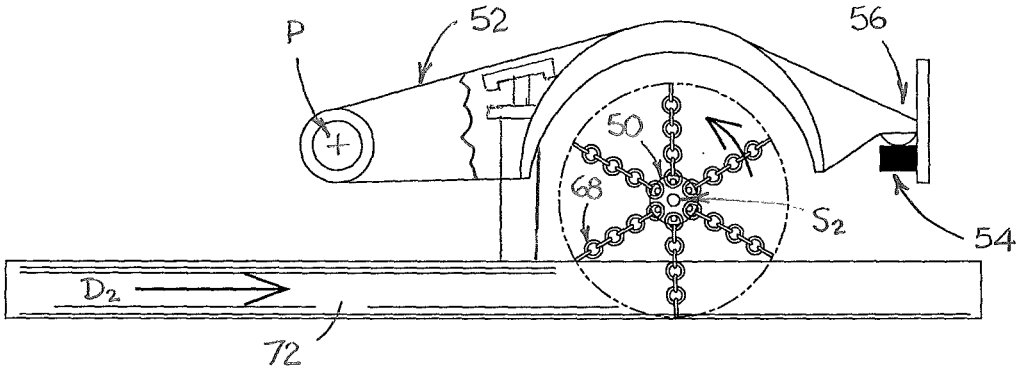
FIG. 8 is a side view of a portion of a flail housing and a flail assembly of a preferred embodiment of the invention, showing the operation of a flail assembly with chains of the second length that is mounted in the lower position in the flail housing in connection with the debarking of a log of the second size.

As shown in FIGS. 3-6, shaft 50 is mounted with respect to the frame of the machine in upper position $S_1$. Similarly, shaft 50 in FIGS. 7 and 8 is mounted with respect to the frame in lower position $S_2$. $S_1$ and $S_2$ are two of a plurality of alternative vertical positions that may be selected for locating shaft 50 with respect to the frame of the debarking machine. At both positions $S_1$ and $S_2$, shaft 50 is adapted for rotation about an axis that is perpendicular to the plane of the page on which the view is shown. Shaft 50 is also located in flail housing 52 that is attached to the machine frame so as to pivot about pivot axis P in FIGS. 3-8 under the influence of linear actuator 66. Support stop 54 is adjustably mounted to the machine housing near free end 56 of flail housing 52 to prevent the free end from falling below any of a plurality of preselected vertical positions, wherein said vertical position is determined by the size of the log being processed, the length of the flail chains in the flail assembly and the vertical location of the flail shaft in the flail housing, in order to prevent the flail chains from damaging other components of the machine.

Figure 3:
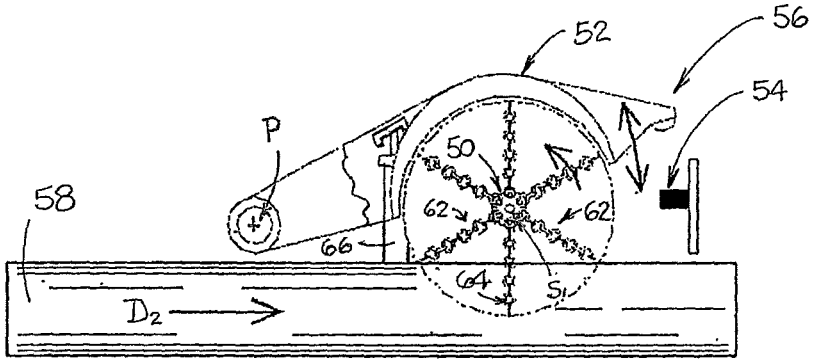
FIG. 3 is a side view of a portion of a flail housing and a flail assembly of a preferred embodiment of the invention, showing the operation of a flail assembly having chains of a first length that is mounted in an upper position in the flail housing in connection with the debarking of a log of a first size.
Figure 4:
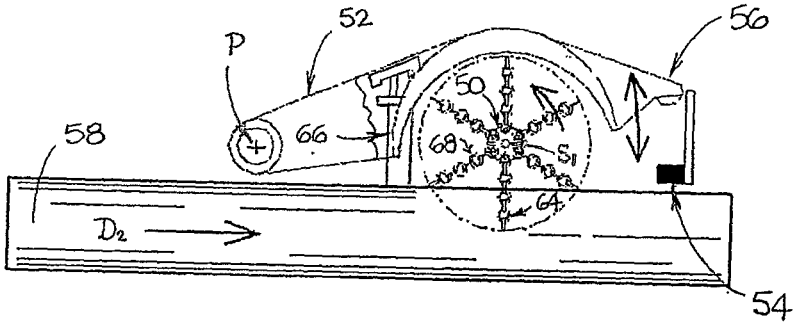
FIG. 4 is a side view of a portion of a flail housing and a flail assembly of a preferred embodiment of the invention, showing the operation of a flail assembly having chains of a second length that is shorter than the first length, which flail assembly is mounted in the upper position in the flail housing, in connection with the debarking of a log of the first size.

FIGS. 3 and 4 illustrate embodiments of the invention for processing of log 58 of relatively large diameter with the flail shaft mounted at the upper position $S_1$ in the flail housing, using flail chains of a first length (FIG. 3) and a second, shorter length (FIG. 4). FIGS. 5 and 6 illustrate embodiments of the invention for processing of log 60 of relatively small diameter with the flail shaft mounted at the upper position $S_1$ in the flail housing, using flail chains of the first length (FIG. 5) and the second length (FIG. 6). FIG. 7 illustrates an embodiment of the invention for processing of log 70 of relatively large diameter with the flail shaft mounted at the lower position $S_2$ in the flail housing, using flail chains of the second length, and FIG. 8 illustrates an embodiment of the invention for processing of log 72 of relatively small diameter with the flail shaft mounted at the lower position $S_2$ in the flail housing, using flail chains of the second length.

As shown in FIG. 3, six flail chains 62 of a first length, each of which is comprised of ten chain links 64, are attached to shaft 50, which is mounted for rotation with respect to flail housing 52 and the frame of the machine at upper vertical position $S_1$. Linear actuator 66 is mounted between flail housing 52 and the machine frame to generate a linearly directed force of a magnitude that counterbalances at least a portion of the weight of the flail housing. Since the log being processed is of a relatively large diameter, the flail shaft is mounted at upper position $S_1$, and the flail chains 62 are of the first length, adjustable support stop 54 is located at an intermediate position in order to prevent the flail chains from damaging other components of the machine as the flail assembly "floats" with respect to the surface of the log being processed.

FIG. 4 illustrates a configuration of the flail assembly that may be employed when one or more chain links on the free end of one or more flail chains are damaged, broken or lost in operation of the flail assembly, or if it is desirable for another reason to replace flail chains 62 with shorter flail chains. As shown therein, six flail chains 68 of a second length which is less than the first length of flail chains 62, are attached to shaft 50, which is mounted for rotation with respect to the flail housing and the frame of the machine at upper vertical position $S_1$. Each of flail chains 68 is comprised of eight chain links 64. Linear actuator 66, mounted between flail housing 52 and the machine frame, generates a linearly directed force of a magnitude that counterbalances at least a portion of the weight of the flail housing. Since the log being processed is of a relatively large diameter, the flail shaft is mounted at upper position $S_1$, and the flail chains 68 are of the second length, adjustable support stop 54 is located at a lower position in order to prevent the flail chains from damaging other components of the machine as the flail assembly "floats" with respect to the surface of the log being processed.

As shown in FIG. 5, six flail chains 62 of the first length, each of which is comprised of ten chain links 64, are attached to shaft 50, which is mounted for rotation with respect to the housing and the frame of the debarking machine at upper vertical position $S_1$. Linear actuator 66 is mounted between flail housing 52 and the machine frame. In this embodiment of the invention, linear actuator 66 generates a linearly directed force of a magnitude that counterbalances at least a portion of the weight of the flail housing. Since the log being processed is of a relatively small diameter, the flail shaft is mounted at upper position $S_1$, and the flail chains 62 are of the first length, adjustable support stop 54 is located at an intermediate position in order to prevent the flail chains from damaging other components of the machine as the flail assembly "floats" with respect to the surface of the log being processed.

FIG. 6 illustrates a configuration of the flail assembly for use in connection with a log of smaller relative diameter when one or more chain links on the free end of one or more flail chains are damaged, broken or lost in operation of the flail assembly, or if it is desirable for another reason to replace flail chains 62 with shorter flail chains. As shown therein, six flail chains 68 of the second length which is less than the first length of flail chains 62, are attached to shaft 50, which is mounted for rotation with respect to the flail housing and the frame of the machine at upper vertical position $S_1$. Each of flail chains 68 is comprised of eight chain links 64. Linear actuator 66, mounted between flail housing 52 and the machine frame, generates a linearly directed force of a magnitude that counterbalances at least a portion of the weight of the flail housing. Since the log being processed is of a relatively small diameter, the flail shaft is mounted at upper position $S_1$, and the flail chains 68 are of the second length, adjustable support stop 54 is located at a lower position in order to prevent the flail chains from damaging other components of the machine as the flail assembly "floats" with respect to the surface of the log being processed.

FIG. 7 illustrates a configuration of the flail assembly in which six flail chains 68 of the second length, each of which is comprised of eight chain links 64, are attached to shaft 50, which is mounted for rotation with respect to the housing at lower vertical position $S_2$. Linear actuator 66 is mounted between flail housing 52 and the machine frame to generate a linearly directed force that counterbalances at least a portion of the weight of the flail housing. Since the log being processed is of a relatively large diameter, the flail shaft is mounted at lower position $S_2$, and the flail chains 68 are of the second length, adjustable support stop 54 is located at a lower position in order to prevent the flail chains from damaging other components of the machine as the flail assembly "floats" with respect to the surface of the log being processed.

FIG. 8 illustrates a configuration of the flail assembly for use in connection with a log of smaller relative diameter. As shown therein, six flail chains 68, each of which is comprised of eight chain links 64, are attached to shaft 50, with is mounted for rotation with respect to the flail housing and the frame of the debarking machine at lower vertical position $S_2$. Linear actuator 66, mounted between flail housing 52 and the machine frame, generates a linearly directed force that counterbalances at least a part of the weight of the flail housing. Since the log being processed is of a relatively small diameter, the flail shaft is mounted at lower position $S_2$, and the flail chains 68 are of the second length, adjustable support stop 54 is located at a lower position in order to prevent the flail chains from damaging other components of the machine as the flail assembly "floats" with respect to the surface of the log being processed.

The configuration of components shown in the drawings may also be employed with flail chains having lengths that are different from the first and second lengths described herein. Various flail assembly mounting configurations and/or the use of flail chains of different lengths may be employed to change the vertical location of the shaft of a flail assembly so that when the damaged chain links on the flail chains are removed, or shorter flail chains are substituted, the shortened free ends of the flail chains will extend as far or nearly as far as the free ends of the original (or undamaged) flail chains, or otherwise as far as is desired.

Although this description contains many specifics, these should not be construed as limiting the scope of the invention but as merely providing illustrations of the presently preferred embodiments thereof, as well as the best mode contemplated by the inventors of carrying out the invention. The invention, as described and claimed herein, is susceptible to various modifications and adaptations, as would be understood by those having ordinary skill in the art to which the invention relates.

What is claimed is:

1. A debarking machine for removing the bark from a log, said debarking machine including:

(a) a flail assembly comprising:
  (i) a flail shaft that is mounted for rotation about a flail shaft axis;
  (ii) a plurality of flail chains, each of which has a fixed end that is attached to the flail shaft and a free end;
(b) means for moving the log in a processing direction that is generally perpendicular to the flail shaft axis;
(c) a flail housing that encloses a portion of the flail assembly, which flail housing:
  (i) is adapted to locate the flail shaft at any of a plurality of alternative vertical positions with respect to the log being moved in the processing direction;
  (ii) has a pivot end that is pivotally attached to the frame of the debarking machine and a free end;
(d) wherein said debarking machine further includes a linear actuator that is mounted between the flail housing and the frame of the machine, said linear actuator being adapted to generate a linearly directed force that counterbalances at least a part of the weight of the flail housing;
(e) wherein said debarking machine further includes a support stop that is adjustably mounted to the frame of the machine near the free end of the flail housing and adapted to prevent the free end of the flail housing from falling below a preselected vertical position with respect to the log being moved in the processing direction.

2. A debarking machine for removing the bark from a log, said debarking machine comprising:

(a) a flail assembly comprising:

(i) a flail shaft that is mounted for rotation about a flail shaft axis;

(ii) a plurality of flail chains, each of which has a fixed end that is attached to the flail shaft and a free end;

(b) means for moving the log in a processing direction that is generally perpendicular to the flail shaft axis;

(c) a flail housing that encloses a portion of the flail assembly, said flail housing:

(i) including a pair of flail housing sidewalls;

(ii) having a pivot end that is pivotally attached to the frame of the debarking machine;

(iii) having a free end;

(d) a pair of mounting brackets, each of which is adapted to:

(i) receive an end of the flail shaft;

(ii) be attached to a flail housing sidewall opposite the other mounting bracket in a plurality of alternative vertical positions with respect to the log being moved in the processing direction;

(e) a linear actuator that is mounted between the flail housing and the frame of the machine, said linear actuator being adapted to generate a linearly directed force that counterbalances at least a part of the weight of the flail housing;

(f) a support stop that is adjustably mounted to the frame of the machine near the free end of the flail housing and adapted to prevent the free end of the flail housing from falling below any of a plurality of preselected alternative vertical positions with respect to the log being moved in the processing direction.

3. The debarking machine of claim 2 wherein the flail housing:

(a) comprises a support structure for the flail assembly;

(b) cooperates with the linear actuator and the support stop to locate the flail shaft at any of a plurality of preselected alternative vertical positions with respect to the log being moved in the processing direction without the support structure for the flail assembly making contact with the log being processed.

* * * * *